US005335484A

United States Patent [19]

Hain

[11] Patent Number: 5,335,484

[45] Date of Patent: Aug. 9, 1994

[54] SHEET HANDLING APPARATUS

[75] Inventor: David A. Hain, Monifieth, Scotland

[73] Assignee: NCR Corporation, Dayton, Ohio

[21] Appl. No.: 44,928

[22] Filed: Apr. 8, 1993

Related U.S. Application Data

[63] Continuation of Ser. No. 785,971, Oct. 31, 1991, abandoned.

[30] Foreign Application Priority Data

Jun. 4, 1991 [GB] United Kingdom ..... 9112025.3

[51] Int. Cl.[5] ..... B65B 27/08

[52] U.S. Cl. ..... 53/582; 53/586; 156/541; 902/12; 902/15; 902/17

[58] Field of Search ..... 53/553, 582, 586; 156/238, 541, 542; 209/534; 902/12, 14, 15, 16, 17, 18, 38, 41

[56] References Cited

U.S. PATENT DOCUMENTS

| | | | |
|---|---|---|---|
| 3,446,328 | 5/1969 | Boyce et al. | 53/553 X |
| 3,849,968 | 11/1974 | Tateisi | 53/553 X |
| 3,957,173 | 5/1976 | Roudebush | 902/15 X |
| 4,204,381 | 5/1980 | Timmerbeil | 53/586 X |
| 4,435,243 | 3/1984 | Azeez et al. | 902/18 X |
| 4,540,106 | 9/1985 | Fukatsu | 902/17 X |
| 4,627,218 | 12/1986 | Akerstrom et al. | 53/586 X |
| 4,683,708 | 8/1987 | Linder | 53/553 X |
| 4,699,373 | 10/1987 | Nakanishi | 902/16 X |
| 4,709,820 | 12/1987 | Jenkins et al. | 902/16 X |
| 4,954,203 | 9/1990 | Matsumoto | 156/542 X |

FOREIGN PATENT DOCUMENTS

| | | |
|---|---|---|
| 1325398 | 12/1971 | United Kingdom . |
| 1320438 | 6/1973 | United Kingdom . |
| 2125376 | 7/1983 | United Kingdom . |
| 2124005 | 2/1984 | United Kingdom . |
| 2141407 | 12/1984 | United Kingdom . |
| 2213472 | 8/1989 | United Kingdom . |

*Primary Examiner*—John Sipos
*Assistant Examiner*—Daniel Moon
*Attorney, Agent, or Firm*—Albert L. Sessler, Jr.

[57] ABSTRACT

A sheet handling apparatus includes transport mechanism (40, 42) for feeding a stack of sheets, such as currency notes, from a position in which the stack is accessible to a user of the apparatus into a secure container. A stack banding device (138) is arranged to form a band around the stack during feeding of the stack from the accessible position into the container. The band comprises two self-adhesive labels which are respectively peeled off two carrier strips (166) wound around two spools (168) included in the stack banding device (138). A printer is arranged to print stack identification data on each band. The stack banding device (138) may be used in an ATM for identifying a stack of currency notes which a customer has failed to collect at an exit port of the ATM and which has been fed into a rejected note container.

4 Claims, 6 Drawing Sheets

140
150
138
152
12
188
148
28
38
36
164
146
160
176
158
42
40
184
178
154
32
40
172
168
166
42
40
32
42
14

SHEET HANDLING APPARATUS

This is a continuation of co-pending application Ser. No. 07/785,971 filed on Oct. 31, 1991, now abandoned.

BACKGROUND OF THE INVENTION

This invention relates to a sheet handling apparatus.

The invention has application, for example, to a currency note stacking and presenting mechanism included in a cash dispenser unit of an automated teller machine (ATM). As is well known, in operation of an ATM a user inserts a customer identifying card into the machine and then enters certain data (such as codes, quantity of currency required, type of transaction, etc.) upon one or more keyboards included in a user console of the machine. The machine will then process the transaction, update the user's account to reflect the current transaction, dispense cash, when requested, from one or more currency cassettes mounted in the machine, and return the card to the user as part of a routine operation.

A known cash dispenser unit of an ATM includes at least one note picking mechanism for extracting notes one by one from associated currency cassette, stacking means for accumulating the extracted notes into a stack, and transport means for feeding the stack of notes to a delivery port or exit slot in the ATM from where the stack may be removed by a user of the ATM. If for any reason it is determined that the stack of notes is to be rejected, for example as a result of a multiple note detect mechanism having detected in the course of a stack operation that two or more notes have been picked in a single pick operation, that instead of feeding the stack to the exit slot the transport mechanism feeds the stack into a rejected note container (purge bin). In operation of this known dispenser unit, another situation where notes are fed into the purge bin is where a user of the ATM fails to remove some or all of the notes presented to him in response to a cash withdrawal request. Thus, if a determination is made that one or more notes remain present at the exit slot for more than a predetermined period of time, then the transport means is operated so as to feed the uncollected note(s) from the exit slot into the purge bin.

A disadvantage of the known cash dispenser referred to above is that, since both rejected notes and uncollected notes are deposited in the same purge bin, it may be difficult to identify any particular notes in the purge bin in the event of a dispute occurring between a customer and a bank concerning possible failure by the customer to remove some or all of a stack of notes presented to him in response to a cash withdrawal request.

A further known cash dispenser unit of an ATM includes separate collection means for rejected notes and for notes which have been left uncollected by a customer. However, this further known unit has the disadvantage that the provision of such separate collection means adds to the complexity and cost of the unit.

SUMMARY OF THE INVENTION

According to one embodiment of the invention, there is provided a currency note handling apparatus including a housing and an opening in said housing comprising an exit port for providing access to a stack of currency notes at the exit port by a user for removal of said stack of currency notes and also including a container for receiving said stack of currency notes when said stack is not removed from said exit port by said user, comprising: transport means adapted to feed said stack of currency notes along a path from said exit port to said container; and stack banding means operatively associated with said transport means and located in the path of said transport means between said exit port and in the path of said transport means between said exit port and said container, said stack banding means being arranged to form a band around said stack of currency notes during feeding of said stack of currency notes from said exit port into said container, said band comprising first and second strip elements, said stack banding means including first and second dispensing means for dispensing said first and second strip elements; said first and second dispensing means being respectively adapted to hold first and second carrier strips in the form of rolls, each of said carrier strips carrying a series of separate strip elements each having an adhesive bearing surface adhered to the respective carrier strip, said stack banding means also comprising: strip element peeling means for causing said first and second strip elements to be separately peeled away from said first and second carrier strips with the adhesive bearing surfaces of said first and second strip elements facing each other; and band forming means for bringing together first ends of said first and second strip elements downstream of a leading edge of said stack, with said stack positioned between the first and second strip elements, and for subsequently bringing together the other ends of said first and second strip elements upstream of a trailing edge of said stack; said band forming means including first and second roll means between which said stack passes during feeding of said stack from said exit port to said container, said first and second roll means being urged resiliently together during the formation of said band and defining a nip therebetween; said stack banding means also comprising means for bringing about relative movement between said first and second roll means, whereby said first and second roll means may be set to be in cooperative relationship for the purpose of forming said band, or may be set so as to be spaced apart, in which spaced apart setting said band is not formed, said transport means being arranged to feed said stack from a non-accessible position to said exit port between said first and second roll means while said first and second roll means are spaced apart; whereby said stack of currency notes is banded before being fed into said container.

According to another embodiment of the invention, there is provided a currency note handling apparatus including a housing and an opening in said housing comprising an exit port for providing access to a stack of currency notes at the exit port by a user for removal of said stack of currency notes and also including a container for receiving said stack of currency notes when said stack is not removed from said exit port by said user, comprising: transport means adapted to feed said stack of currency notes along a path from said exit port to said container; and stack banding means operatively associated with said transport means and located in the path of said transport means between said exit port and said container, said stack banding means being arranged to form a band around said stack of currency notes during feeding of said stack of currency notes from said exit port into said container, said band comprising first and second strip elements, said stack banding means including first and second dispensing means for dispensing said first and second strip elements; said first and second dispensing means being respectively adapted to hold first and second carrier strips in the form of rolls, each of said carrier strips carrying a series of separate strip elements each having an adhesive bearing surface adhered to the respective carrier strip, said stack banding means also comprising: strip element peeling means for causing said first and second strip elements to be separately peeled away from said first and second carrier strips with the adhesive bearing surfaces of said first and second strip elements facing each other; and band forming means for bringing together first ends of said first and second strip elements downstream of a leading edge of said stack, with said stack positioned between the first and second strip elements, and for subsequently bringing together the other ends of said first and second strip elements upstream of a trailing edge of said stack; said band forming means including first and second roll means between which said stack passes during feeding of said stack from said exit port to said container, said first and second roll means being urged resiliently together during the formation of said band and defining a nip therebetween; said stack banding means also comprising first and second guide means and first and second strip pulling means, respectively arranged to pull said first and second carrier strips away from the respective dispensing means and around ends of said first and second guide means, respectively, whereby that surface of each carrier strip remote from the respective strip elements makes an acute angle as it passes around the end of the guide means; also including first and second support means on which said first and second dispensing means, said first and second roll means and said first and second guide means are respectively mounted, said first and second support means being pivotally movable between first positions in which said first and second roll means are in cooperative relationship for the purpose of forming said band and second positions in which said first and second roll means are spaced apart, and in which second positions said band is not formed; whereby said stack of currency notes is banded before being fed into said container.

With reference to the immediately preceding paragraph, it should be understood that a stack could comprise a single sheet. Also, it should be understood that by an accessible position is meant a position at which the stack is accessible for removal by hand from the apparatus.

It is an object of the invention to provide a sheet handling apparatus suitable for alleviating the above-mentioned disadvantages of known cash dispenser units.

BRIEF DESCRIPTION OF THE DRAWINGS

With this and other objects, which will become apparent from the following description, in view, the invention includes certain novel features of construction and combinations of parts, a preferred form or embodiment of which is hereinafter described with reference to the drawings which accompany and form a part of this specification.

DETAILED DESCRIPTION

Figure 1:
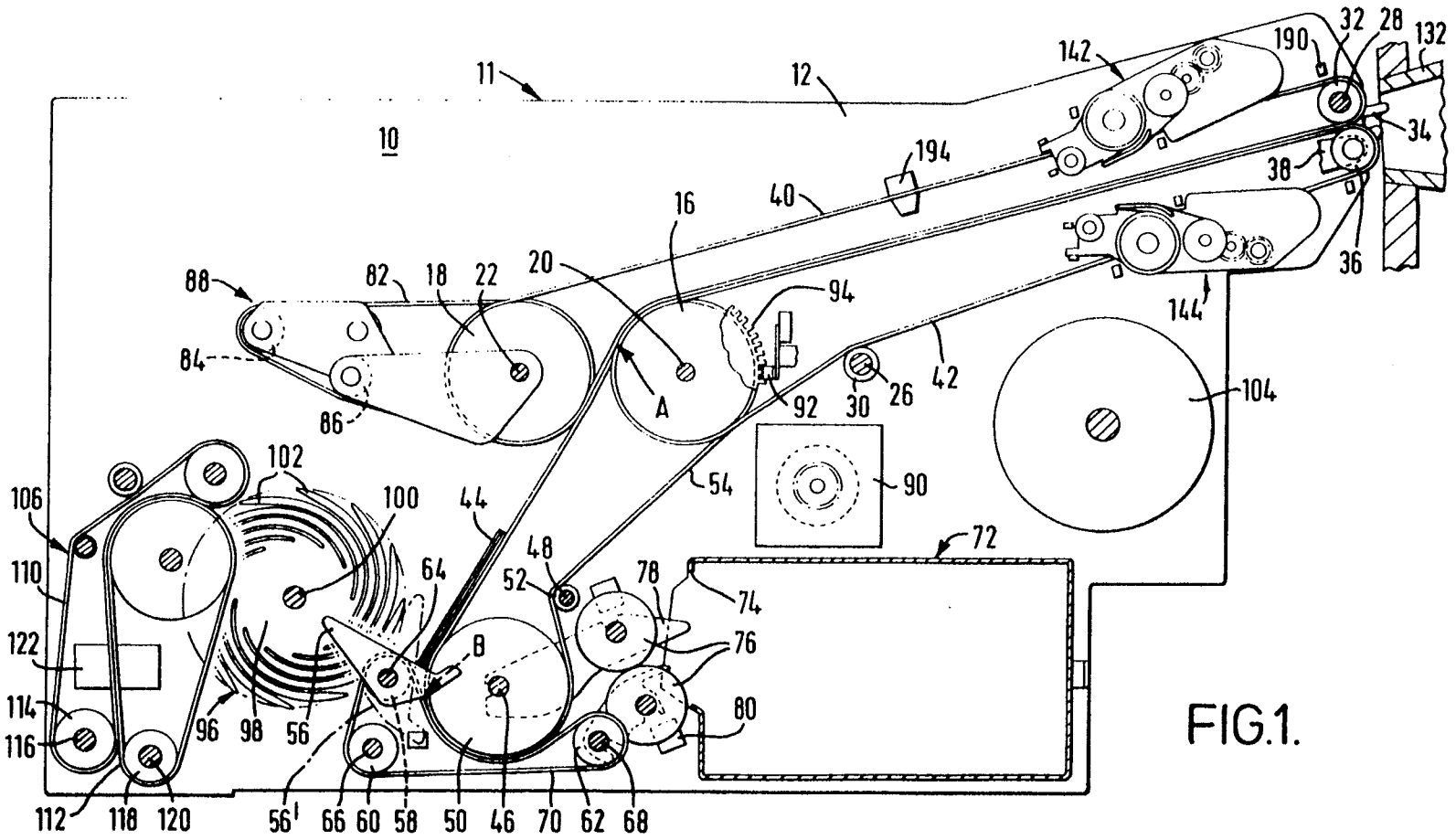
FIG. 1 is a side elevational view, shown partly in section, of a currency note stacking and presenting mechanism of an ATM including a stack banding device in accordance with the invention, one of the side walls of a supporting framework of the mechanism being omitted for the sake of clarity.
Figure 2:
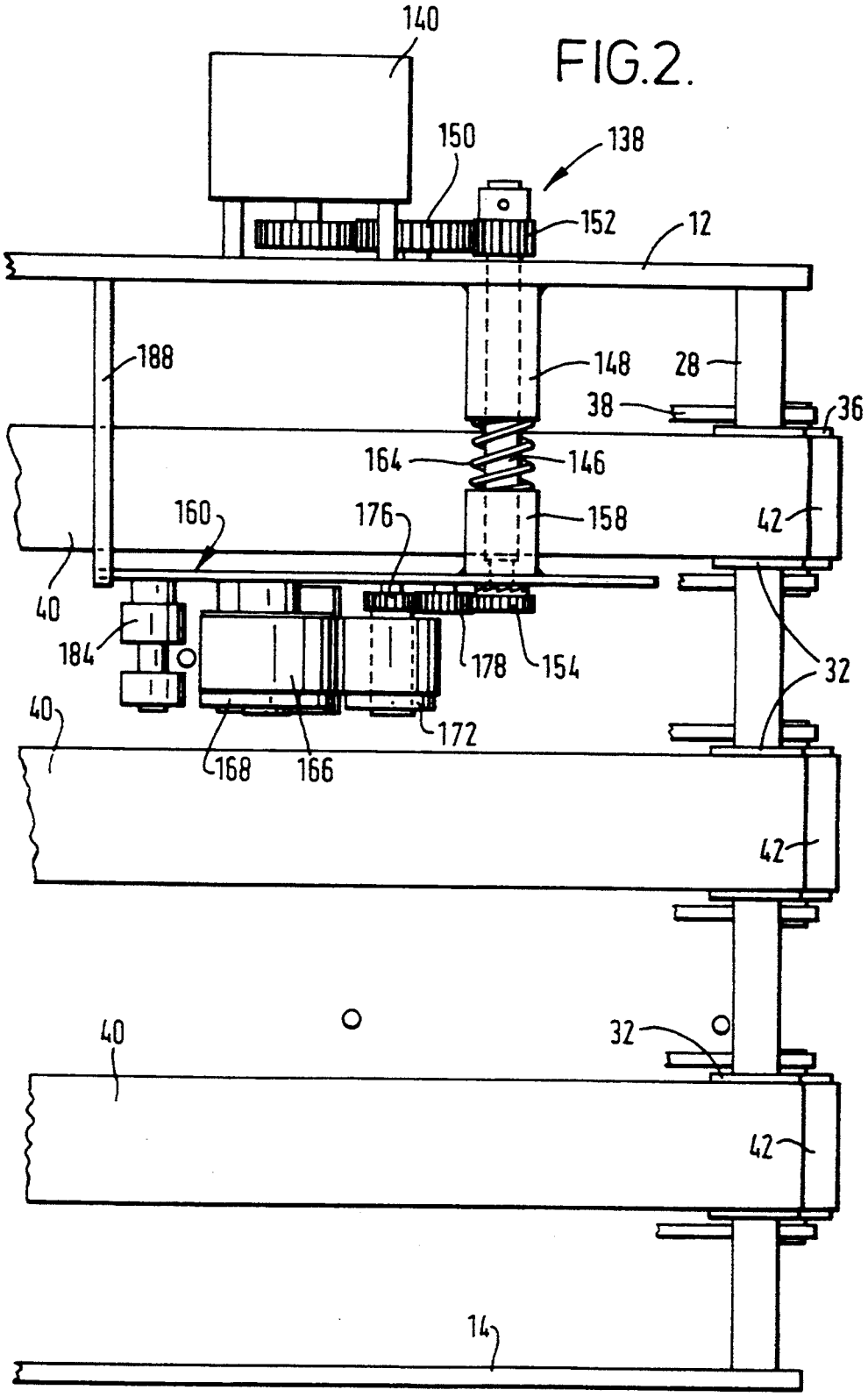
FIG. 2 is an enlarged plan view of that part of the mechanism of FIG. 1 incorporating the stack banding device.
Figure 11:
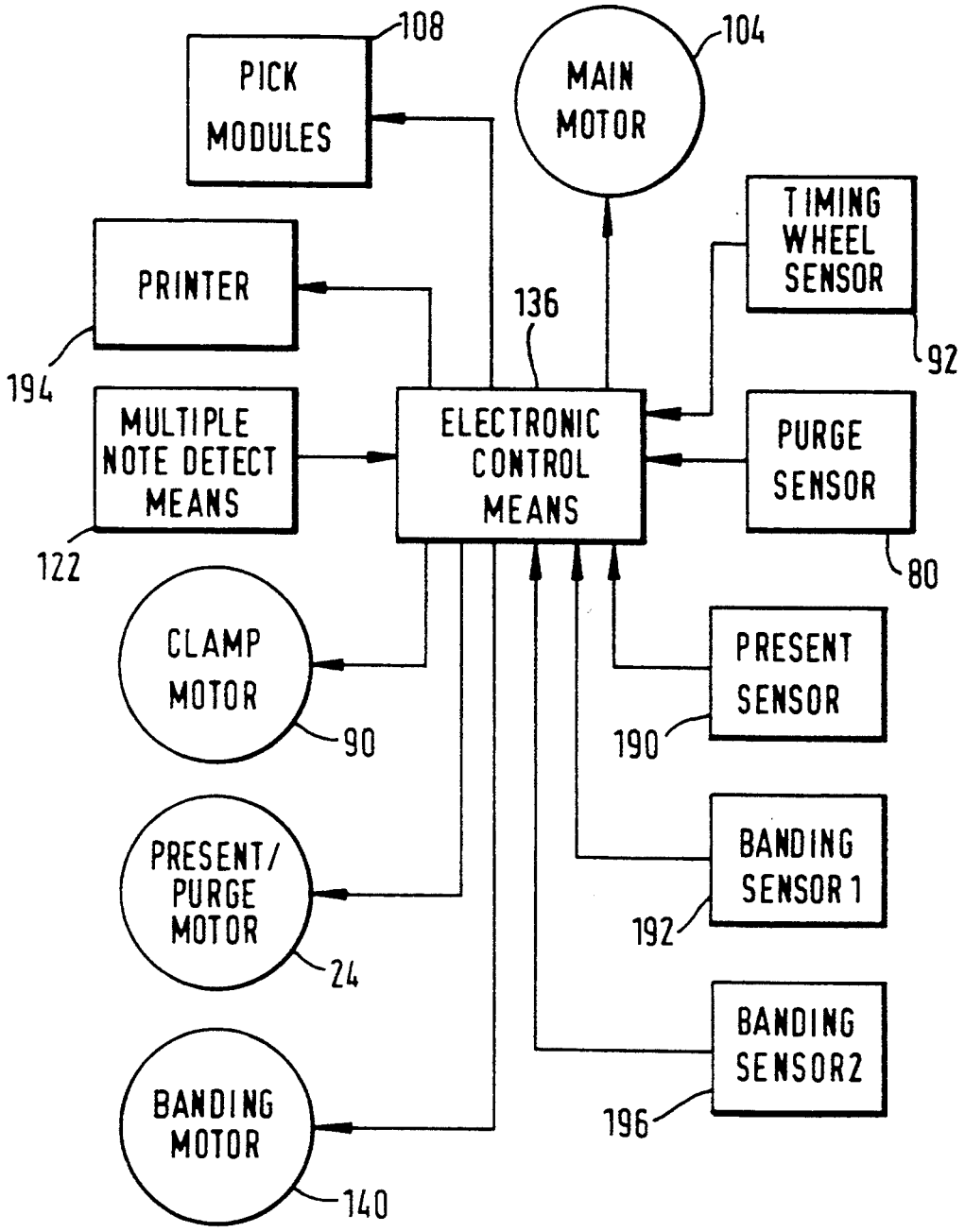
FIG. 11 is a schematic block diagram illustrating the electrical interconnections of parts of the cash dispenser unit.

Referring to FIG. 1 and 2, the stacking and presenting mechanism 10 shown therein includes a supporting framework 11 having side walls 12 and 14. Two composite pulleys 16 and 18 are respectively rotatably mounted on two parallel shafts 20 and 22 which extend between the side walls 12 and 14, the axes of the shafts 20 and 22 lying in the same horizontal plane. Each of the composite pulleys 16 and 18 includes five pulley portions (not separately seen) spaced apart along the relevant shaft 20 or 22. The composite pulleys 16 and 18 are driven by a reversible electric stepping motor 24 (FIG. 11) via a gear system (not shown).

Two further shafts 26 and 28 extend between the side walls 12 and 14, and two sets of pulleys 30 and 32 are rotatably mounted on the shafts 26 and 28, each of these sets comprising three pulleys which are spaced apart along the relevant shaft 26 or 28. The set of pulleys 32 is located in an upper portion of the framework 11 adjacent an exit port 34 of the stacking and presenting mechanism 10. Another set of three pulleys 36 is located beneath, and in cooperative relationship with respect to, the pulleys 32. The pulleys 36 are rotatably mounted on resiliently mounted support means 38 whereby the pulleys 36 are urged resiliently towards the pulleys 32.

Three resiliently stretchable endless belts 40 pass around the pulleys 32 and the composite pulley 18, and partly around the periphery of the composite pulley 16 as seen in FIG. 1, each belt 40 being cooperatively associated with a correspondingly located pulley 32 and with correspondingly located pulley portions of the composite pulleys 16 and 18. Three further resiliently stretchable endless belts 42 pass around the pulleys 36 and the composite pulley 16 and over the pulleys 30, again as seen in FIG. 1, each belt 42 being cooperatively associated with correspondingly located pulleys 36 and 30 and with a correspondingly located pulley portion of the composite pulley 16. It should be understood that the lower parts of the belts 40 extending between the pulleys 16 and 32 are respectively in cooperative engagement with the upper parts of the belts 42 extending between the pulleys 16 and 36. As will be described in more detail later, in operation of the stacking and presenting mechanism 10, a stack of currency notes 44 comprising a variable number of notes can be fed to the exit port 34 of the mechanism 10 by virtue of being gripped between the cooperating parts of the belts 40 and 42.

Referring to FIG. 1, located beneath the composite pulleys 16 and 18 are two shafts 46 and 48 which extend between the side walls 12 and 14, two pulleys means 50 and 52 being respectively rotatably mounted on the shafts 46 and 48. Resiliently stretchable endless belt means 54 pass around the pulleys means 50 and the composite pulley 16, and over the pulley means 52. It should be understood that the belt means 54 comprise two separate belts which are interposed with respect to the three belts 42 where these five belts pass around the composite pulley 16. As shown in FIG. 1, prior to the stack of notes 44 being fed to the exit port 34, the stack 44 rests against the belt means 54 with the lower long edges of the notes in the stack 44 being supported by arms 56 (only one of which is shown) spaced apart between the side walls 12 and 14.

Three further pulley means 58, 60 and 62 are included in the mechanism 10, the pulley means 58 and 60 being respectively rotatably mounted on two shafts 64 and 66 extending between the side walls 12 and 14, and the pulley means 62 being secured on a drive shaft 68 extending between, and rotatably mounted with respect to, the side walls 12 and 14. The drive shaft 68 is driven by the electric motor 24 (FIG. 11) via a gear system (not shown). Further resiliently stretchable endless belt means 70 pass around the pulley means 58, 60 and 62, and partially around the periphery of the pulley means 50.

It should be understood that the upper part of the belt means 70 extending between the pulley means 58 and 62 is respectively in resilient engagement with that part of the belt means 54 in contact with the pulley means 50. By virtue of the resilient nature of the engagement of the belt means 70 with the belt means 54, a stack of rejected currency notes, comprising a variable number of notes, can be fed by the belt means 70 and 54, while gripped between the cooperating parts thereof, towards a rejected note container 72 (hereinafter referred to as the purge bin 72), the rejected notes being deposited in the purge bin 72 via an opening 74 in one side thereof. After leaving the belt means 54 and 70, the leading edge of the stack of rejected notes is gripped by cooperating sets of foam rubber feed rolls 76 which, together with guide means 78, serve to feed the stack into the purge bin 72. The feed rolls 76 are driven by the motor 24, and the resilient nature of the rolls 76 enables them to feed a stack of notes of variable thickness. The passage of a stack of rejected currency notes into the purge bin 72 is sensed by optical sensing means 80.

Further resiliently stretchable endless belt means 82 pass around pulley means 84 and 86 forming part of a clamp arm assembly 88, and around the composite pulley 18. It should be understood that the belt means 82 comprise two separate belts which are interposed with respect to the three belts 40 where these five belts pass around the composite pulley 18. Normally, the clamp arm assembly 88 is in the position shown in FIG. 1. Under the control of an electric stepping motor 90, the clamp arm assembly 88 can be pivoted from its normal position in a counterclockwise direction (with reference to FIG. 1) about the axis of the shaft 22 by means of a gear system and cam means (not shown) so as to bring the belt means 82 into cooperative relationship with the belt means 54 with the stack of notes 44 gripped between the belt means 82 and 54. It should be understood that the pulley means 84 are resiliently mounted so that a stack of notes 44 of variable thickness can be trapped between the belt means 82 and the belt means 54. The cooperating parts of the belt means 82 and 54 extend between a location adjacent the periphery of the pulley means 50 and a location at which the belt means 82 and 54 are in cooperative relationship with respect to the periphery of the composite pulley 18. With the stack of notes 44 gripped between the belt means 82 and 54, the stack 44 can be fed by the belt means 82 and 54 to the nip A of the belts 40 and 42 from where the stack 44 is fed by the belts 40 and 42 to the exit port 34. Alternatively, the stack of notes 44 gripped between the belt means 82 and 54 can be fed by the belt means 82 and 54 to the nip B of the belt means 54 and 70 from where the stack is fed by the belt means 54 and 70 and the feed rolls 76 into the purge bin 72, the arms 56 having first been pivoted out of the way into the position 56' shown in chain outline in FIG. 1.

After the stack of notes 44 has been fed to the exit port 34 or to the purge bin 72, the clamp arm assembly 88 is pivoted in a clockwise direction back to its home position shown in FIG. 1 under the control of the motor 90.

An optical sensing means 92 is positioned in cooperative relationship with respect to a timing wheel 94 secured to the composite pulley 16, the sensing means 92 generating in operation a series of timing pulses in response to rotation of the composite pulleys 16 and 18.

The stacking and presenting mechanism 10 includes a conventional stacking wheel 96 which is arranged to rotate continuously in operation in a clockwise direction with reference to FIG. 1. The stacking wheel 96 comprises a plurality of stacking plates 98 spaced apart in parallel relationship along a stacking wheel shaft 100, each stacking plate 98 incorporating a series of curved tines 102. The shaft 100 extends between, and is rotatably mounted with respect to, the side walls 12 and 14, and the shaft 100 is driven via transmission means (not shown) by an electric motor 104. The stacking wheel 96 cooperates with the arms 56 (hereinafter referred to as stripper arms 56) which are spaced apart along the shaft 64 and are secured thereto, the shaft 64 being rotatably mounted with respect to the side walls 12 and 14. Each stripper arm 56 is positioned between an adjacent pair of stacking plates 98.

During a stacking operation, the stripper arms 56 are positioned as shown in solid outline in FIG. 1 with each stripper arm 56 extending into the space between adjacent stacking plates 98. In such operation, currency notes are fed one by one to the stacking wheel 96 by a transport mechanism 106. Each note enters between adjacent tines 102 of the stacking plates 98 and is carried partly around the axis of the stacking wheel 96, the note being stripped from the wheel 96 by the stripper arms 56 and being stacked against the belt means 54 with a long edge of the note being supported by the stripper arms 56. Pivotal movement of the stripper arms 56 between their home position shown in solid outline in FIG. 1 and the nonsupporting position 56' is controlled by the electric motor 90 via cam means and link means (not shown).

The transport mechanism 106 serves to feed currency notes from a selected pick module 108 (FIG. 3) to the stacking wheel 96. The mechanism 106 includes two sets of cooperating endless belts 110 and 112. The belts 110 are driven by a set of pulleys 114 mounted on a drive shaft 116, and the belts 112 are driven by a set of pulleys 118 mounted on a drive shaft 120, the shafts 116 and 120 being driven via transmission means (not shown) by the motor 104. In operation, each currency note fed to the transport mechanism 106 is gripped between the belts 110 and 112 and is fed by the belts 110 and 112 to the stacking wheel 96 where the note is deposited between adjacent tines 102 of the stacking plates 98. A multiple note detect means 122, schematically indicated as a box in FIG. 1, is positioned part way along the cooperating parts of the belts 110 and 112 for the purpose of detecting the passage of superposed notes between the belts 110 and 112.

Figure 3:
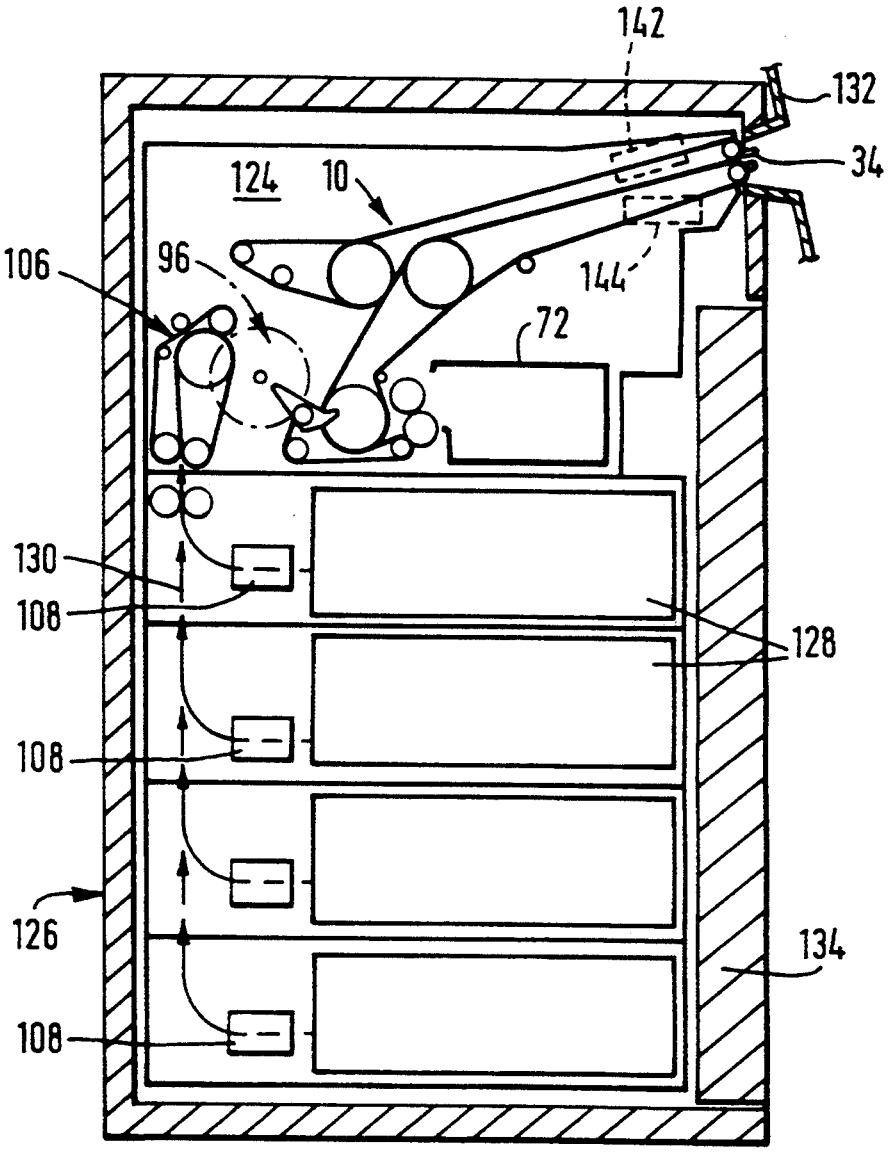
FIG. 3 is a schematic side elevation view of an ATM having a cash dispenser unit incorporating the stack banding device of FIGS. 1 and 2.

Referring now particularly to FIG. 3, the note stacking and presenting mechanism 10 forms part of a cash dispenser unit 124 of an in-lobby ATM. The mechanism 10 and the pick modules 108 are housed in a safe 126. Each of the pick modules 108 are arranged to pick currency notes one by one from an associated currency cassette 128, and is arranged to feed each note picked from the associated cassette 128 along a common feed path 130 to the transport mechanism 106 of the mechanism 10. Notes picked from one or more of the cassettes 128 are stacked by the mechanism 10 as previously described, and are then presented to a user of the ATM via the delivery port 34 formed in a user console 132 of the ATM.

Alternatively, if a stack of notes is rejected for any reason, for example as a result of the double detect mechanism 122 detecting the passage of superposed notes, the stack is diverted to the purge bin 72. The safe 126 is provided with a door 134 via which the cassettes 128 and the bin 72 can each be removed from the safe 126 as part of a cash replenishment or bin emptying operation. The cash dispenser unit 124 includes electronic control means 136 (FIG. 11) which controls the operation of the motors 24, 90 and 104 and the pick modules 108, and to which are applied outputs of the sensor means 80 and 92 and the multiple note detect mechanism 122. It should be understood that the main drive motor 104 operates the stacking wheel 96, the drive shafts 116 and 120, and the pick modules 108.

Referring now particularly to FIGS. 2, 4, 5, and 6, the stacking and presenting mechanism 10 includes a stack banding device 138. The device 138 includes a bidirectional stepping motor 140 (FIG. 2) which is mounted on the side wall 12 and which is arranged to drive upper and lower banding mechanisms 142 and 144. The lower banding mechanism 144 is a mirror image of the upper mechanism 142 and operates in the same manner as the upper mechanism 142. Accordingly, only the upper banding mechanism 142 will be described in detail. In the description and in the drawings, corresponding elements of the mechanisms 142 and 144 have the same reference numerals.

Referring particularly to the mechanism 142, this mechanism includes a shaft 146 rotatably mounted in a hub 148 secured to the side wall 12. The shaft 146 is arranged to be driven by the motor 140 via a gear mechanism 150 and a gear wheel 152 secured to an end portion of the shaft 146 projecting a short distance beyond the side wall 12. A gear wheel 154 is secured to that end of the shaft 146 remote from the side wall 12, that face of the gear wheel 154 facing the side wall 12 being provided with ratchet teeth 156 (most clearly shown in FIG. 5). A hub 158, to which is secured an arm assembly 160, is rotatably mounted on the shaft 146. The arm assembly 160 is positioned between two of the belts 40 as shown in FIG. 2, with the axis of the shaft 146 extending above the belts 40. That face of the arm assembly 160 remote from the side wall 12 is provided with ratchet teeth 162 (see FIG. 5) which are adapted to mate with the ratchet teeth 156. Normally, the teeth 162 are held in resilient engagement with the teeth 156 by means of a compression spring 164 which is mounted around the shaft 146 and the ends of which respectively engage with the hubs 148 and 158. The configuration of the ratchet teeth 156 and 162 is such that, when the shaft 146 is driven in a counterclockwise direction (with reference to FIG. 4) by the motor 140, the arm assembly 160 is urged to pivot in a counterclockwise direction about the axis of the shaft 146 by virtue of the friction between the ratchet teeth 156 and 162.

Figure 4:
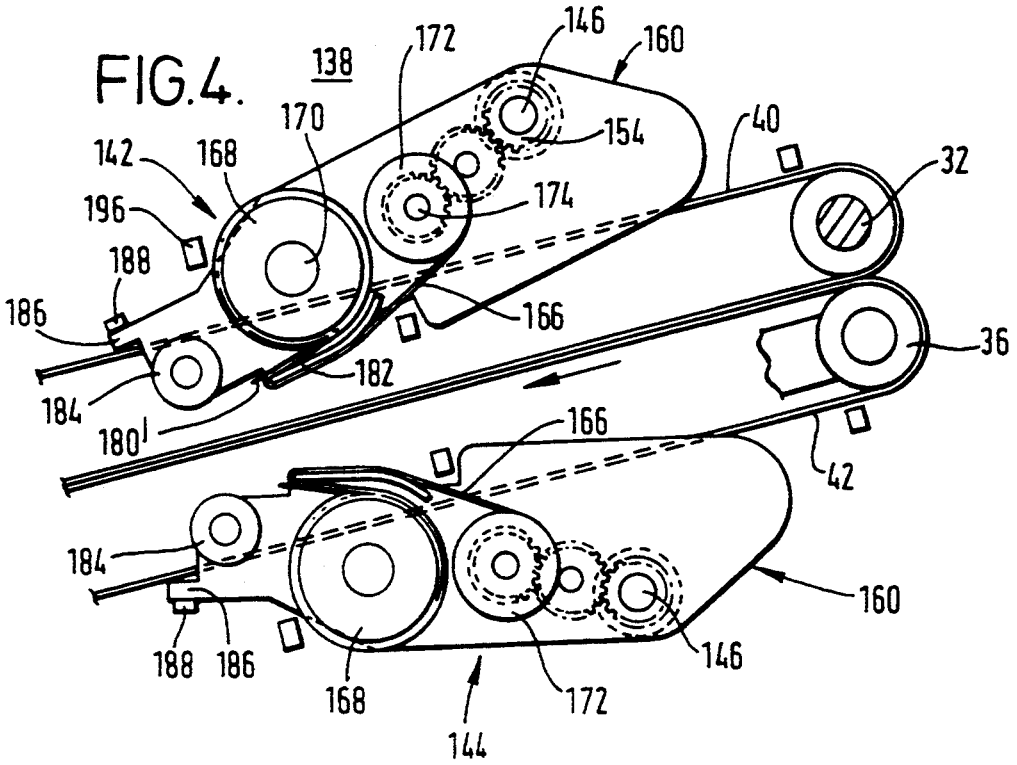
FIG. 4 is a side elevational view of the stack banding device and associated parts of the stacking and presenting mechanism of FIG. 1.
Figure 5:
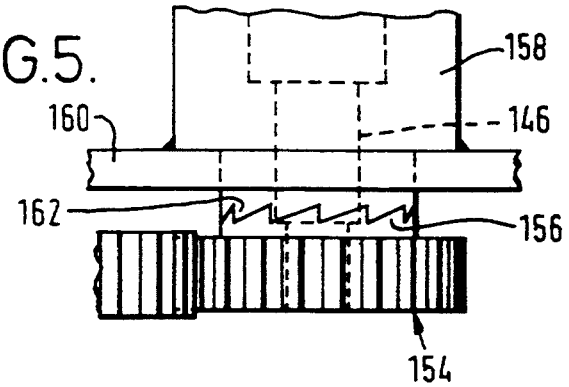
FIG. 5 is an enlarged view of part of the stack banding device as shown in FIG. 2.

Thus, with the arm assembly 160 in its home position shown in FIG. 4, upon the motor 140 being energized so as to rotate the shaft 146 in a counterclockwise direction, the arm assembly 160 pivots in a counterclockwise direction between two of the belts 40. Upon this movement of the arm assembly 160 being stopped, the shaft 146 will continue to rotate with the teeth 156 slipping over the teeth 162.

Still referring to the mechanism 142, this mechanism utilizes a plastic carrier strip 166 comprising a first roll portion carried by a spool 168 rotatably mounted on a stud 170 forming part of the arm assembly 160, and a second roll portion carried by a take-up spool 172 secured on a shaft 174 which is supported by, and rotatably mounted with respect to, the arm assembly 160. The take-up spool 172 is arranged to be driven by a gear wheel 176 secured on the shaft 174, the gear wheel 176 being arranged to be driven by the gear wheel 154 via an intermediate gear wheel 178 rotatably mounted on the arm assembly 160. It should be understood that rotation of the shaft 146 in a counterclockwise direction (with reference to FIG. 4) relative to the arm assembly 160 brings about rotation of the take-up spool 172 in a counterclockwise direction so as to cause the carrier strip 166 to be wound from the spool 168 on to the take-up spool 172.

Figure 6:
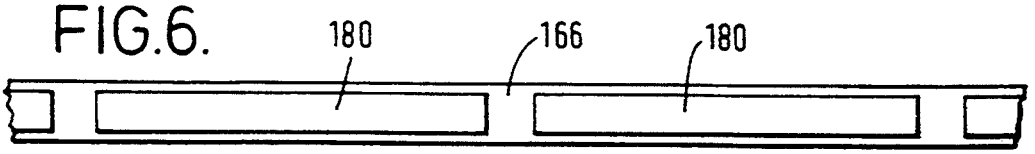
FIG. 6 is a view of part of a carrier strip and adhering labels used in the stack banding device.

As shown in FIG. 6, the carrier strip 166 carries on one side thereof a series of elongated self-adhesive labels 180 spaced apart at equal intervals along the carrier strip 166 with the adhesive side of each label 180 adhering to the strip 166. Typically, adjacent ends of adjacent labels 180 on the carrier strip 166 are spaced apart by 12 millimeters. The carrier strip 166 is wound on the spool 168 with the labels 180 facing inwardly. As best seen in FIG. 4, the section of the carrier strip 166 extending between the spools 168 and 172 passes around an end of a stripper plate 182 forming part of the arm assembly 160, the carrier strip 166 turning through 180° as it passes around said end. By virtue of this arrangement, during rotation of the spools 168 and 172, when a label 180 carried by the carrier strip 166 reaches the relevant end of the stripper plate 182 this label 180 commences to be peeled off the carrier strip 166. As will be described in more detail later, as the relevant portion of the carrier strip 166 moves through 180° around the relevant end of the stripper plate, the last-mentioned label 180 is progressively peeled off the carrier strip 166 until the label 180 becomes completely detached from the strip 166. When the arm assembly 160 is in its home position as shown in FIG. 4, with the spools 168 and 172 stationary, the leading end 180' of one of the labels 180 carried by the carrier strip 166 has become detached from the strip 166 and projects a short distance beyond the relevant end of the stripper plate 182.

A pressure roll 184 is rotatably mounted on an end portion of the arm assembly 160 remote from the pulleys 32 and 36 of the stacking and presenting mechanism 10. This end portion of the arm assembly 160 is provided with a lug 186 which is arranged to engage with a stop member 188 when the arm assembly 160 is in its home position shown in FIG. 4. The arm 160 is held in this home position by virtue of a small holding current applied to the motor 140 so as to urge the shaft 146 to rotate in a clockwise direction (with reference to FIG. 4). It should be understood that, because the ratchet teeth 156 positively engage, without slippage, with the ratchet teeth 162 when the shaft 146 is urged to rotate in a clockwise direction, no rotation of the shaft 146 in a clockwise direction is possible when the lug 186 is in engagement with the stop member 188.

Figure 7:
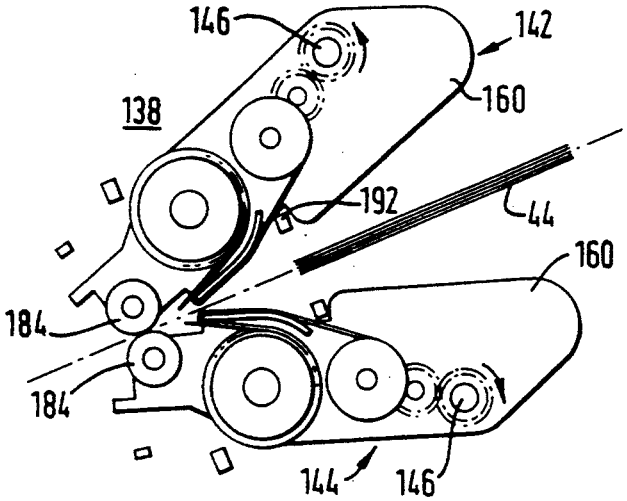
FIGS. 7 to 10 are side elevational views of the stacking banding device illustrating different stages in the operation of this device.

The foregoing detailed description of the stack banding device 138 has been with reference to the upper banding mechanism 142. It should be understood that the shaft 146 of the lower banding mechanism 144 is connected to the motor 140 via the gear mechanism 150 in such a manner that the shafts 146 of the upper and lower banding mechanism 142 and 144 rotate in opposite directions. Thus, for example, the take-up spool 172 of the lower banding mechanism 144 rotates in a clockwise direction when the relevant carrier strip 166 is being unwound from the associated spool 168. Upon the motor 140 being energized so as to rotate the shafts 146 of the mechanism 142 and 144 in counterclockwise and clockwise directions respectively (with reference to FIG. 4), the arm assemblies 160 of the mechanism 142 and 144 pivot from their home positions in counterclockwise and clockwise directions respectively until the pressure rolls 184 of the mechanisms 142 and 144 come into engagement with each other as shown in FIG. 7, the rolls 184 being pressed together in resilient manner by virtue of the frictional engagement between the ratchet teeth 156 and 162 of each of the mechanisms 142 and 144.

The operation of the cash dispenser unit 124, and particularly the operation of the stack banding device 138, will now be described with additional reference to FIGS. 7 to 11. Immediately prior to a cash dispenser operation being initiated, the motors 24, 90, 104 and 140 are in a deactivated condition, and the clamp assembly 88 and the stripper arms 56 are in the positions shown in solid outline in FIG. 1. A cash dispensing operation is initiated by a user inserting a customer identifying card into a card entry slot (not shown) in the user console 132 and entering appropriate data upon keyboard means (not shown) also included in the user console 132. As a result of this operation being initiated, the main drive motor 104 is activated by the control means 136 so as to operate the transport mechanism 106 and cause the stacking wheel 96 to commence rotation. Currency notes are then picked one by one from a selected one or selected ones of the cassettes 128 in response to the application of signals to the relevant pick module or modules 108 by the control means 136. The picked notes are fed by the transport mechanism 106 to the stacking wheel 96 which stacks the notes in known manner against the stationary belt means 54 so as to form the stack 44.

When the correct number of notes have been stacked against the belt means 54, the control means 136 deactivates the motor 104 and sends a signal to the motor 90 to activate the motor 90 so as to bring about pivotal movement of the clamp arm assembly 88 in a counterclockwise direction (with reference to FIG. 1) and thereby cause the stack of notes 44 to be clamped between the belt means 82 and 54; at the same time, the stripper arms 56 are moved to the position 56' shown in chain outline in FIG. 1 in which the arms 56 are no longer in engagement with, or in a path of movement of, the stack of notes 44. Shortly after the stack of notes 44 is clamped between the belt means 82 and 54, the control means 136 deactivates the motor 90.

Thereafter, the control means 136 sends a signal to the motor 24 so as to activate the motor 24 in such a sense as to cause the belt means 82 and 54 to feed the stack of notes 44 to the nip A of the belts 40 and 42 from where the stack 44 is fed by the belts 40 and 42 to the exit port 34 of the ATM.

As the stack of notes 44 is fed to the exit port 34 a sensor means (not shown) senses the trailing edge of the stack 44, and a predetermined time thereafter, as determined by the application of timing pulses to the electronic control means 136 by the timing wheel sensor 92, the control means 136 deactivates the motor 24 so as to stop the stack 44 in a delivery position in which part of the stack 44 projects through the exit port 34 and part of the stack 44 is held between the belts 40 and 42. After being fed to the delivery position, the stack of notes 44 can be readily removed from the user console 132 by the user of the ATM.

An optical sensing device 190 positioned adjacent the exit port 34 applies a signal to the electronic control means 136 indicative of whether or not a stack of notes is positioned at the exit port 34. If the presented stack 44 is not removed from the console 132 by the user of the ATM within a predetermined period of time the electronic control means 136 causes the stack 44 to be withdrawn into the dispenser unit and deposited in the purge bin 72 by reversing the operation of the motor 24. If the stack 44 is removed from the console 132 within the allowed time, then the control means 136 activates the motor 90 in the reverse sense so as to cause the stripper arms 56 and the clamp assembly 88 to be returned to their home positions shown in the solid outline in FIG. 1.

If for any reason it is determined that the stack of notes 44 accumulated against the stationary belt means 54 is to be rejected, for example as a result of the multiple note detect mechanism 122 having detected in the course of the stacking operation that two or more notes have been picked in a single pick operation, then the stack of notes 44 will be fed to the purge bin 72 in the manner previously described, under the control of the electronic control means 136. It should be understood that, as the stack of notes 44 approaches the bin 72, the sensor means 80 senses the leading edge of the stack. Shortly after the sensor means 80 senses the leading edge of the stack, the electronic control means 136 deactivates the motor 24 and temporarily activates the motor 90 for the purpose of returning the stripper arms 56 and the clamp assembly 88 to their home positions.

Assuming that the stack 44 has been fed to the exit port 34 but has not been removed from the user console 132 within the allowed time then, as previously mentioned, the electronic control means 136 energizes the motor 24 in the reverse sense. As the stack 44 is fed by the belts 40 and 42 back towards the composite pulleys 16 and 18, an optical sensing device 192 (FIG. 7) included in the stack banding means 138 senses the leading edge of the stack 44, in response to which the electronic control means 136 energizes the motor 140 so as to rotate the shafts 146 of the upper and lower banding mechanisms 142 and 144 in counterclockwise and clockwise directions respectively.

Figure 8:
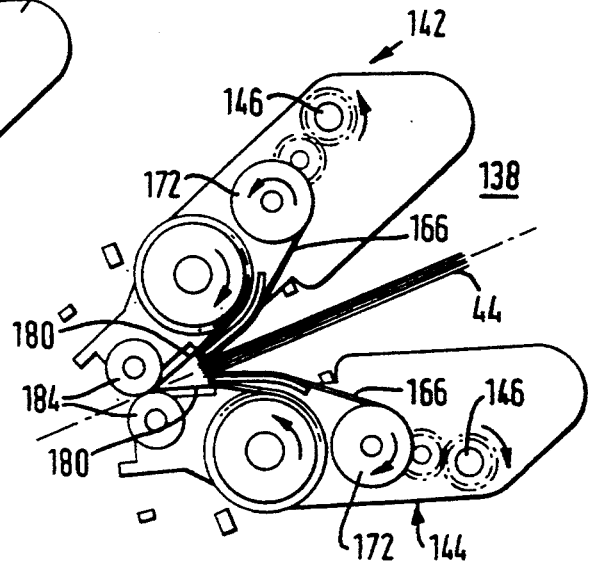

Initially, this rotation of the shafts 146 brings about pivotal movement of the two arm assemblies 160 in opposite senses, as previously described, so as to bring the pressure rolls 184 into resilient engagement with each other as shown in FIG. 7. Upon this pivotal movement of the arm assemblies 160 being completed, with the pressure rolls 184 in engagement with each other, the take-up spools 172 commence to rotate relative to the arm assemblies 160, due to continued rotation of the shafts 146, so as to cause the two carrier strips 166 to commence to be unwound from the spools 168 on to the take-up spools 172. This unwinding movement causes correspondingly located labels 180 carried by the two carrier strips 166 to be progressively peeled off the carrier strips 166, with the adhesive coated sides of the labels 180 facing each other, until the leading ends of these labels 180 reach the nip of the pressure rolls 184, as shown in FIG. 8, with the leading edge of the stack 144 positioned between these labels 180.

Figure 9:
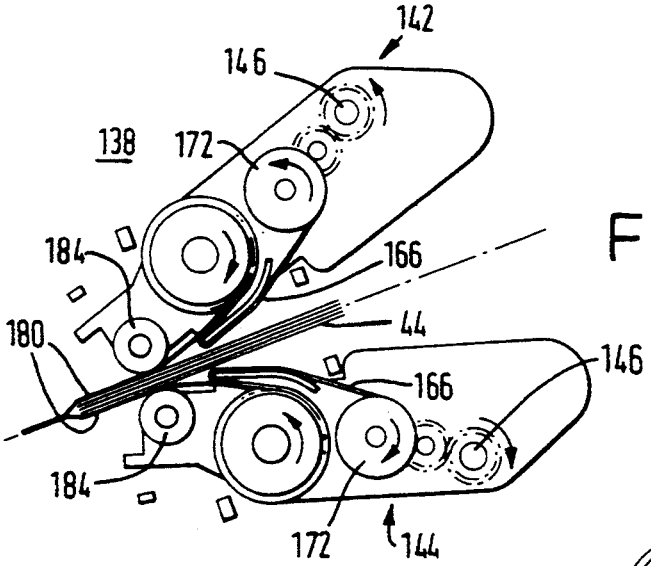
Figure 10:
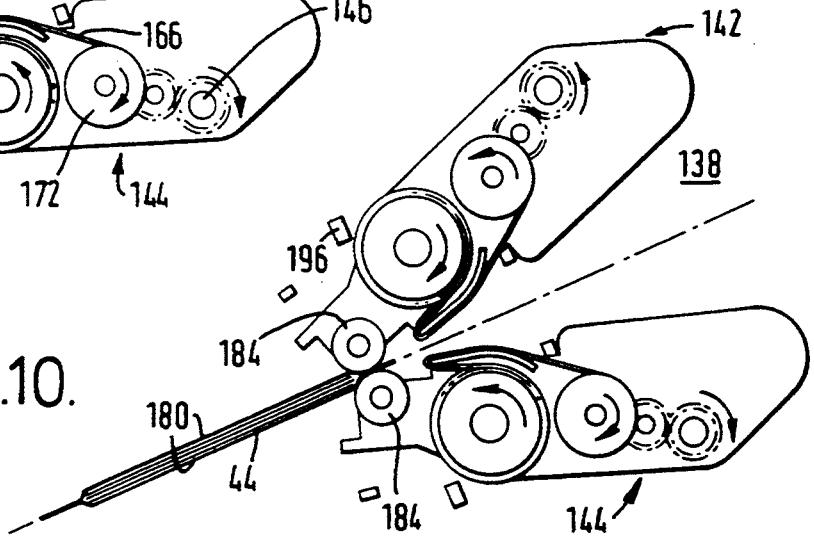

Continued rotation of the shafts 146 and take-up rolls 172 causes the correspondingly located labels 180 to continue to be peeled off the carrier strips 166, thereby causing the leading ends of these labels 180 to be pushed between the pressure rolls 184. The pressure exerted by the pressure rolls 184 on the labels 180 causes their leading ends to be adhered firmly together, downstream of the leading edge of the stack 44. Continued feeding movement of the stack of notes 44 towards the composite pulleys 16 and 18 causes the stack 44 to pass between the pressure rolls 184, as shown in FIG. 9, with the stack 44 located between the two labels 180, the pressure rolls 184 being forced slightly apart to accommodate the stack 44, against the action of the ratchet teeth 156 and 162. The pressure exerted by the pressure rolls 184 on the labels 180 causes the labels 180 to adhere firmly to opposite faces of the stack 44. Eventually the trailing edge of the stack 44 moves past the pressure rolls 184 as shown in FIG. 10, whereupon the trailing edges of the two labels 180 are caused to adhere firmly together by the pressure rolls 184, upstream of the trailing edge of the stack 44.

Thus, the two labels 180, one from each of the spools 168, form a band around the stack 44, with the leading and trailing ends of the labels 180 adhering firmly together and with the stack 44 firmly held between the main central portions of the labels 180. After the banded stack 44 has left the stack banding device 138, an ink jet printer 194 (FIG. 1) is caused to print stack identification information on the upper label 180 of the band under the control of the electronic control means 136. Thereafter, the banded stack is fed into the purge bin 72 in the manner previously described.

It should be understood that shortly after the trailing edge of the stack 44 held between the two labels 180 moves past a further optical sensing device 196 (FIGS. 4 and 10), the electronic control means 136 causes the two banding mechanisms 142 and 144 to be returned to their home positions shown in FIG. 4, with the lug 186 of each mechanism 142 or 144 engaging with the associated stop member 188, by temporarily energizing the stepping motor 140 for a predetermined number of steps in the opposite sense to its immediately preceding mode of operation. Also, it should be understood that the electronic control means 136 controls the speed of operation of the motor 140 so that while labels 180 are being peeled off the carrier strips 166 their speed along the feed path for a stack is similar to the speed of the stack.

In an alternative mode of operation to that described above, the labels 180 carried by one of the carrier strips 166 could each carry preprinted identification information, different for each label, whereby each uncollected stack fed to the purge bin 72 could be identified.

It will be appreciated that the stack banding apparatus described above provides a reliable and effective means for identifying any stack of notes which is not collected by a customer at the user console 132 and which is deposited in the purge bin 72, thereby enabling any customer disputes to be readily resolved.

Also, a stack banding device in accordance with the invention could be used in a depository system of an ATM. For example, the device could be used to band together, and identify for accounting purposes, a group of cheques deposited in the ATM by a customer.

While the forms of the invention shown and described herein are admirably adapted to fulfill the object primarily stated, it is to be understood that it is not intended to confine the invention to the forms or embodiments disclosed herein, for it is susceptible of embodiment in various other forms within the scope of the appended claims.

What is claimed is:

1. A currency note handling apparatus including a housing and an opening in said housing comprising an exit port for providing access to a stack of currency notes at the exit port by a user for removal of said stack of currency notes and also including a container for receiving said stack of currency notes when said stack is not removed from said exit port by said user, comprising:

transport means adapted to feed said stack of currency notes along a path from said exit port to said container; and stack banding means operatively associated with said transport means and located in the path of said transport means between said exit port and said container, said stack banding means being arranged to form a band around said stack of currency notes during feeding of said stack of currency notes from said exit port into said container, said band comprising first and second strip elements, said stack banding means including first and second dispensing means for dispensing said first and second strip elements;

said first and second dispensing means being respectively adapted to hold first and second carrier strips in the form of rolls, each of said carrier strips carrying a series of separate strip elements each having an adhesive bearing surface adhered to the respective carrier strip, said stack banding means also comprising: strip element peeling means for causing said first and second strip elements to be separately peeled away from said first and second carrier strips with the adhesive bearing surfaces of said first and second strip elements facing each other; and band forming means for bringing together first ends of said first and second strip elements downstream of a leading edge of said stack, with said stack positioned between the first and second strip elements, and for subsequently bringing together the other ends of said first and second strip elements upstream of a trailing edge of said stack;

said band forming means including first and second roll means between which said stack passes during feeding of said stack from said exit port to said container, said first and second roll means being urged resiliently together during the formation of said band and defining a nip therebetween;

said stack banding means also comprising means for bringing about relative movement between said first and second roll means, whereby said first and second roll means may be set to be in cooperative relationship for the purpose of forming said band, or may be set so as to be spaced apart, in which spaced apart setting said band is not formed, said transport means being arranged to feed said stack from a nonaccessible position to said exit port between said first and second roll means while said first and second roll means are spaced apart;

whereby said stack of currency notes is banded before being fed into said container.

2. The currency note handling apparatus of claim 1, in which said first and second roll means are spaced apart during normal operation of the apparatus in which said stack is removed by said user from said exit port, also including sensing means for sensing when said stack is not removed by said user from said exit port and driving means operable in response to said sensing means for driving said first and second roll means into said cooperative relationship for the purpose of forming said band.

3. A currency note handling apparatus including a housing and an opening in said housing comprising an exit port for providing access to a stack of currency notes at the exit port by a user for removal of said stack of currency notes and also including a container for receiving said stack of currency notes when said stack is not removed from said exit port by said user, comprising:

transport means adapted to feed said stack of currency notes along a path from said exit port to said container; and stack banding means operatively associated with said transport means and located in the path of said transport means between said exit port and said container, said stack banding means being arranged to form a band around said stack of currency notes during feeding of said stack of currency notes from said exit port into said container, said band comprising first and second strip elements, said stack banding means including first and second dispensing means for dispensing said first and second strip elements;

said first and second dispensing means being respectively adapted to hold first and second carrier strips in the form of rolls, each of said carrier strips carrying a series of separate strip elements each having an adhesive bearing surface adhered to the respective carrier strip, said stack banding means also comprising: strip element peeling means for causing said first and second strip elements to be separately peeled away from said first and second carrier strips with the adhesive bearing surfaces of said first and second strip elements facing each other; and band forming means for bringing together first ends of said first and second strip elements downstream of a leading edge of said stack, with said stack positioned between the first and second strip elements, and for subsequently bringing together the other ends of said first and second strip elements upstream of a trailing edge of said stack;

said band forming means including first and second roll means between which said stack passes during feeding of said stack from said exit port to said container, said first and second roll means being urged resiliently together during the formation of said band and defining a nip therebetween;

said stack banding means also comprising first and second guide means and first and second strip pulling means, respectively arranged to pull said first and second carrier strips away from the respective dispensing means and around ends of said first and second guide means, respectively, whereby that surface of each carrier strip remote from the respective strip elements makes an acute angle as it passes around the end of the guide means;

also including first and second support means on which said first and second dispensing means, said first and second roll means and said first and second guide means are respectively mounted, said first and second support means being pivotally movable between first positions in which said first and second roll means are in cooperative relationship for the purpose of forming said band and second positions in which said first and second roll means are spaced apart, and in which second positions said band is not formed;

whereby said stack of currency notes is banded before being fed into said container.

4. The currency note handling apparatus of claim 3, in which said first and second support means are in said second positions during normal operation of the apparatus in which said stack is removed by said user from said exit port, also including sensing means for sensing when said stack is not removed by said user from said exit port and driving means operable in response to said sensing means for driving said first and second support means into said first positions for the purpose of forming said band.

* * * * *